US006845582B1

(12) United States Patent
Ho et al.

(10) Patent No.: US 6,845,582 B1
(45) Date of Patent: Jan. 25, 2005

(54) PHOTO-FRAME STYLE PHOTO ALBUM

(76) Inventors: Shv-Chen Ho, No. 30, Lane 727, Bi-Shan Rd., Tsan Tuen Zhen, Nan Tou Hsien (TW); Chia-Ming Ho, No. 30, Lane 727, Bi-Shan Rd., Tsan Tuen Zhen, Nan Tou Hsien (TW)

( * ) Notice: Subject to any disclaimer, the term of this patent is extended or adjusted under 35 U.S.C. 154(b) by 0 days.

(21) Appl. No.: 10/650,937

(22) Filed: Aug. 27, 2003

(51) Int. Cl.[7] ..... A47G 1/06

(52) U.S. Cl. ..... 40/711; 40/721; 40/723; 40/753; 40/757

(58) Field of Search ..... 40/700, 711, 721, 40/723, 753, 757, 779, 781

(56) References Cited

U.S. PATENT DOCUMENTS 1,601,479 A * 9/1926 Parda ..... 40/721
2,647,834 A * 8/1953 Rabkin et al. ..... 40/753
2,737,745 A * 3/1956 Hartmann ..... 40/721
3,589,049 A * 6/1971 Cornelius ..... 40/722
5,329,712 A * 7/1994 Keller ..... 40/747
5,605,354 A * 2/1997 Kwon ..... 40/721

* cited by examiner

*Primary Examiner*—Gary C. Hoge
(74) *Attorney, Agent, or Firm*—Charles E. Baxley

(57) ABSTRACT

A photo-frame album generally includes a lower frame, a lower divider, an upper frame and an upper divider. The upper divider is disposed on the upper frame, both the lower and the upper frames are provided with magnetic pieces, on inner side of the upper and the lower dividers of the upper and the lower frames are respectively provided stop pieces and further slits. On the rims of the lower and the upper frames are formed with backing surface, plural magnetic pieces are provided on a support stand of the lower frame.

6 Claims, 9 Drawing Sheets

PHOTO-FRAME STYLE PHOTO ALBUM

BACK GROUND OF THE INVENTION

1. Field of the Invention

The present invention relates to a photo album, and more particularly to a photo-frame album.

2. Description of the Prior Arts

A conventional photo-frame album is shown in FIG. 1 and generally including: a box-like structure which is make up of a back board 11, a pair of fixed lateral boards 12, a pair of movable lateral boards 13, a frame-like cover 14, and a support stand (not shown), a photo album 15 is stored in the box-like structure, the user can see the photos directly through the frame-like cover 14 without taking the photo album 15 out of the box-like structure, and with this box-like structure, the photo album 15 is able to stand on table or it can be hanged on the wall. However, this conventional photo frame album still has some disadvantages and which need to be improved as follows:

First, at both sides of the back board 11 is respectively provided the movable lateral board 13, both the frame-like cover 14 and the movable lateral boards 13 are provided with fasteners 141, 131 which enable the frame-like cover 14 to be locked with the back board 11. However, the fasters 141 are susceptible to damage after long time of use.

Second, although the first photograph in the photo album 15 can be seen without taking the photo album 15 out of the box-like structure, the frame-like cover 14 must be lifted up so that the user can browse other pages of the photo album 15. The lateral boards 13 only serve as a link between the frame-like cover 14 and the movable back cover 11. After the frame-like cover 14 is lifted up, the upstanding lateral boards 12 will stand without support on the back board 11, so the user has to be very careful, otherwise the back board 11, the lateral boards 12,13 and the frame-like cover 14 will probably be damaged.

The present invention has arisen to mitigate and/or obviate the aforedescribed disadvantages of the conventional photo-frame album.

SUMMARY OF THE INVENTION

The primary object of the present invention is to provide a photo-frame album, on an upper frame of photo frame album is provided with an upper divider, such that photos of big size can be received in the space between the upper divider and the upper frame.

The secondary object of the present invention is to provide a photo-frame album, wherein both the upper frame and the lower frame of photo frame album are provided with magnetic pieces, so as to prolong the service life of the photo album.

The third object of the present invention is to provide a photo-frame album, on the inner side of the upper and the lower dividers of the upper and the lower frames are respectively provided stop pieces and with a plurality of slits. Different sized photos can be stored by the upper and the lower dividers.

The fourth object of the present invention is to provide a photo-frame album, wherein on the rims of the lower and the upper frames are formed opposite backing surfaces which enable the upper frame to stand on the lower frame, so as to display the photo on the upper divider.

The fifth object of the present invention is to provide a photo-frame album, a support stand disposed on outer side of the lower divider of the lower frame is provided with magnetic pieces corresponding to the magnetic pieces in the receiving groove, so as to prolong the service life of the support stand.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
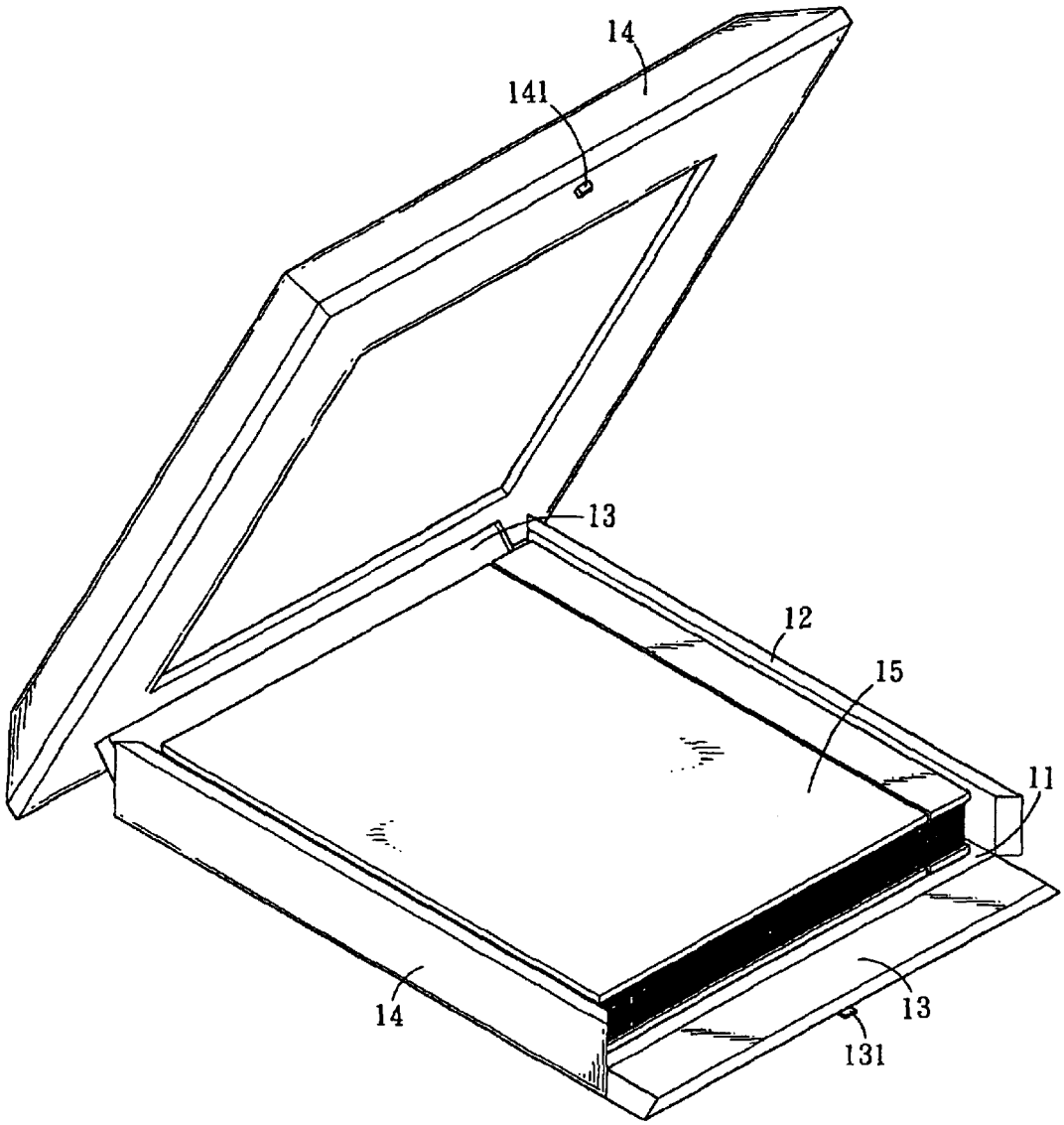
FIG. 1 PRIOR ART
FIG. 1 is a perspective view of a conventional photo-frame album.
Figure 2:
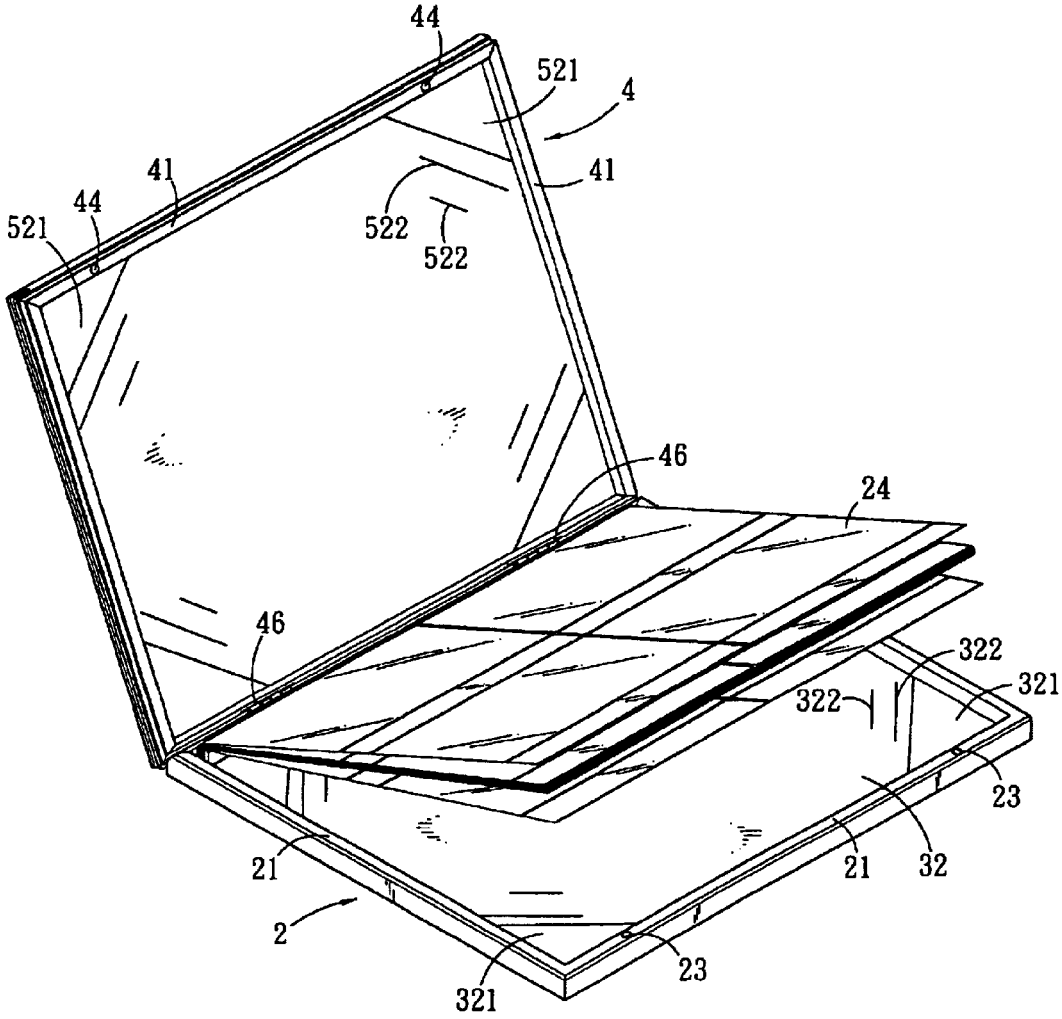
FIG. 2 is a perspective view of a photo-frame album in accordance with the present invention.
Figure 3:
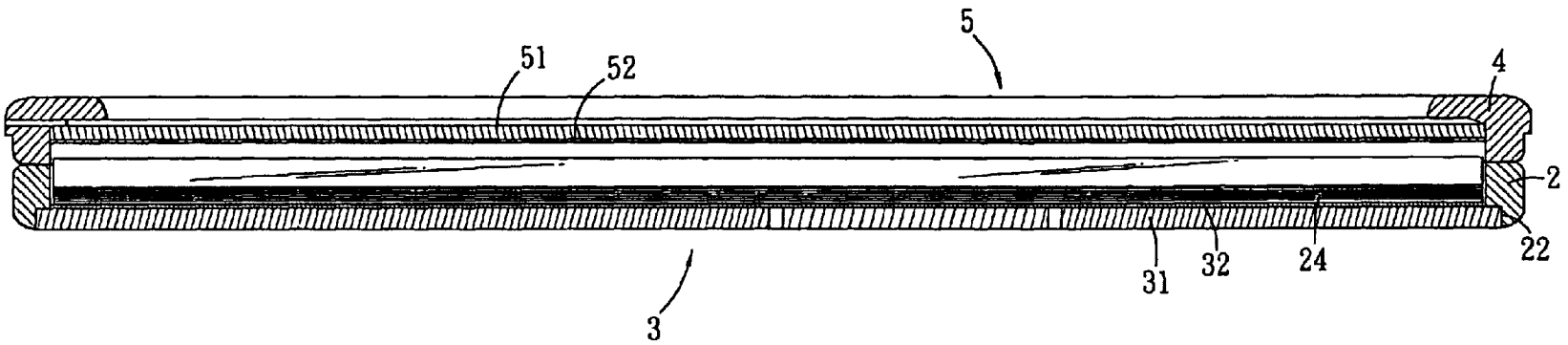
FIG. 3 is a cross sectional view of the photo-frame album in accordance with the present invention.
Figure 4:
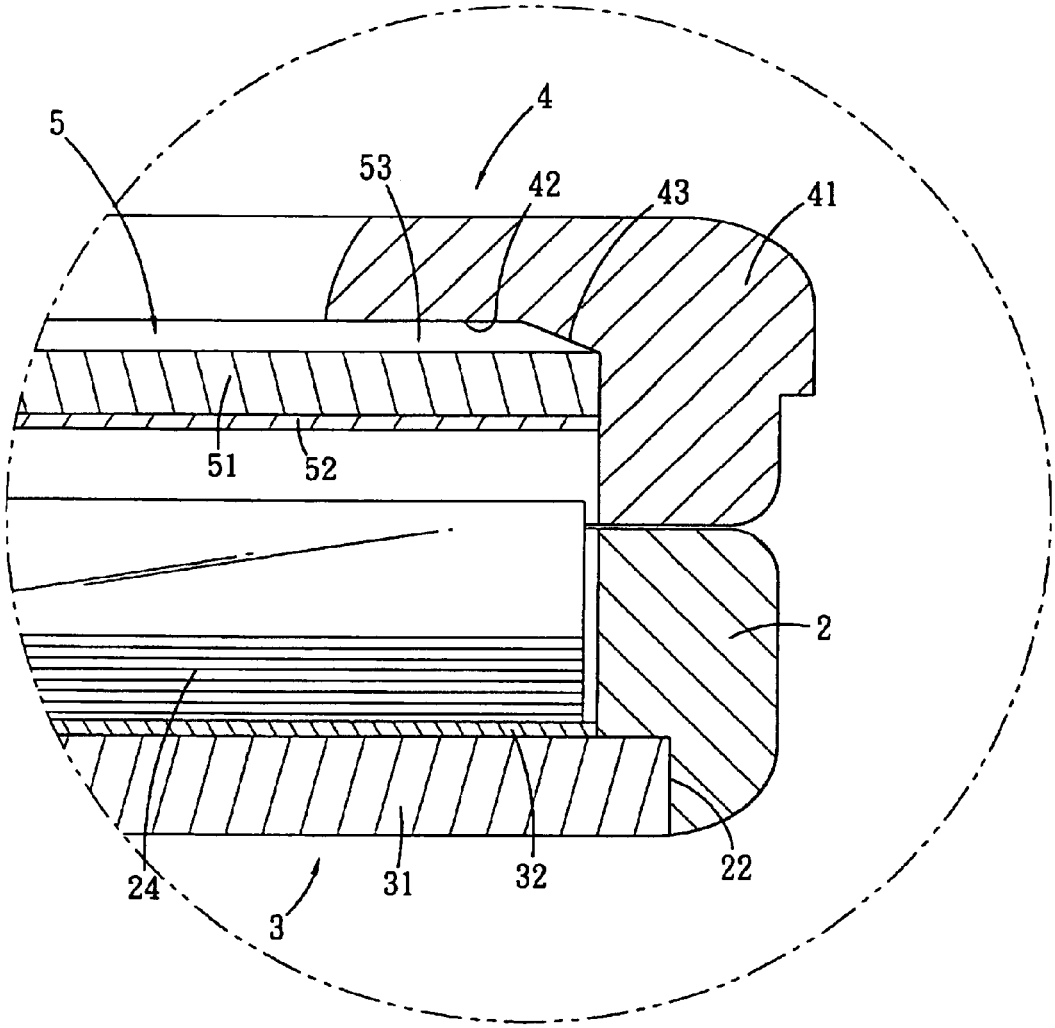
FIG. 4 is a partial amplified view of FIG. 3.

Referring to FIGS. 2–4, wherein a photo frame album in accordance with the present invention is shown and generally comprising: a lower frame 2, a lower divider 3, an upper frame 4 and an upper divider 5.

Figure 5:
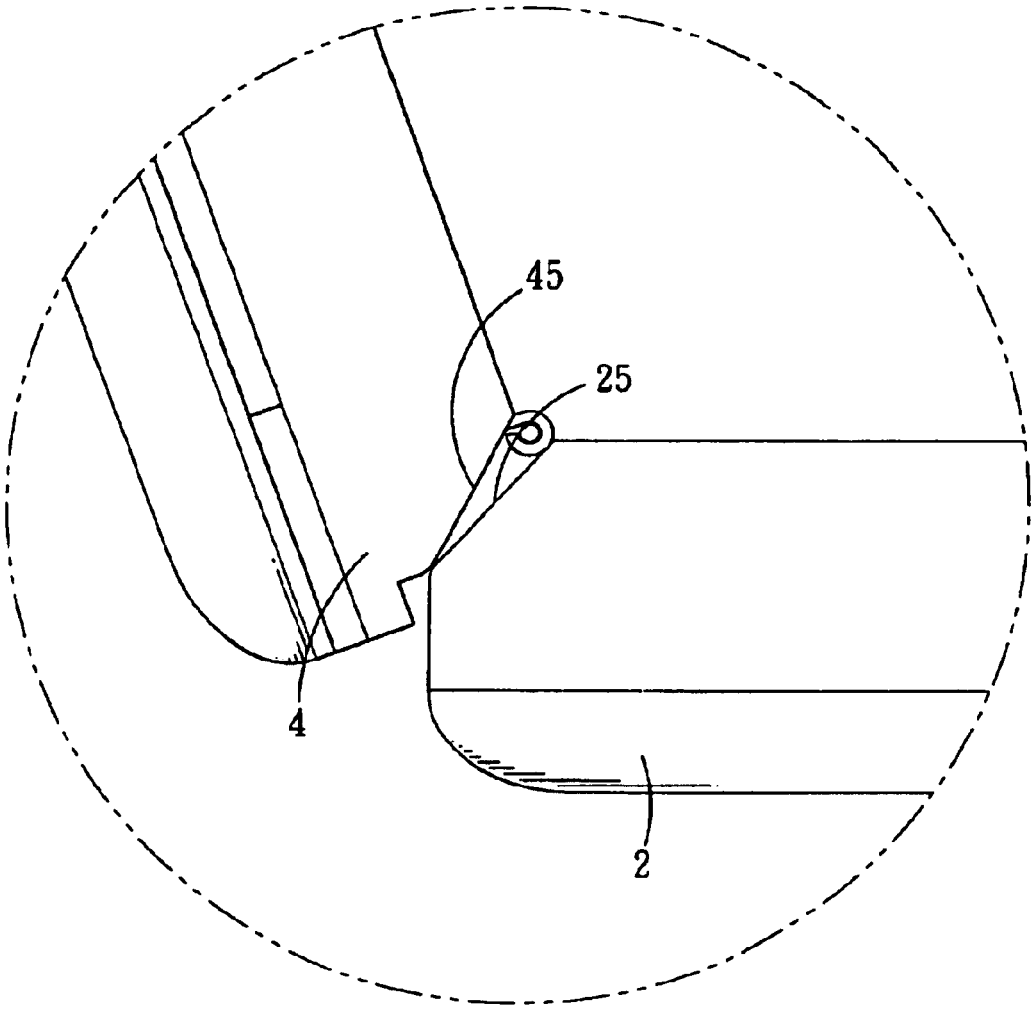
FIG. 5 is an amplified view to show s of a lower and a frame of the photo album in accordance with the present invention.

The lower frame 2 is composed of plural rims 21 and defined with a notch 22. On the rims 21 a plurality of magnetic pieces 23, loose-bags 24 and a backing surface 25 (as shown in FIG. 5) are disposed, respectively (wherein the sizes of loose-bags can be 4"×6", 6"×8", 10"×12").

Figure 6:
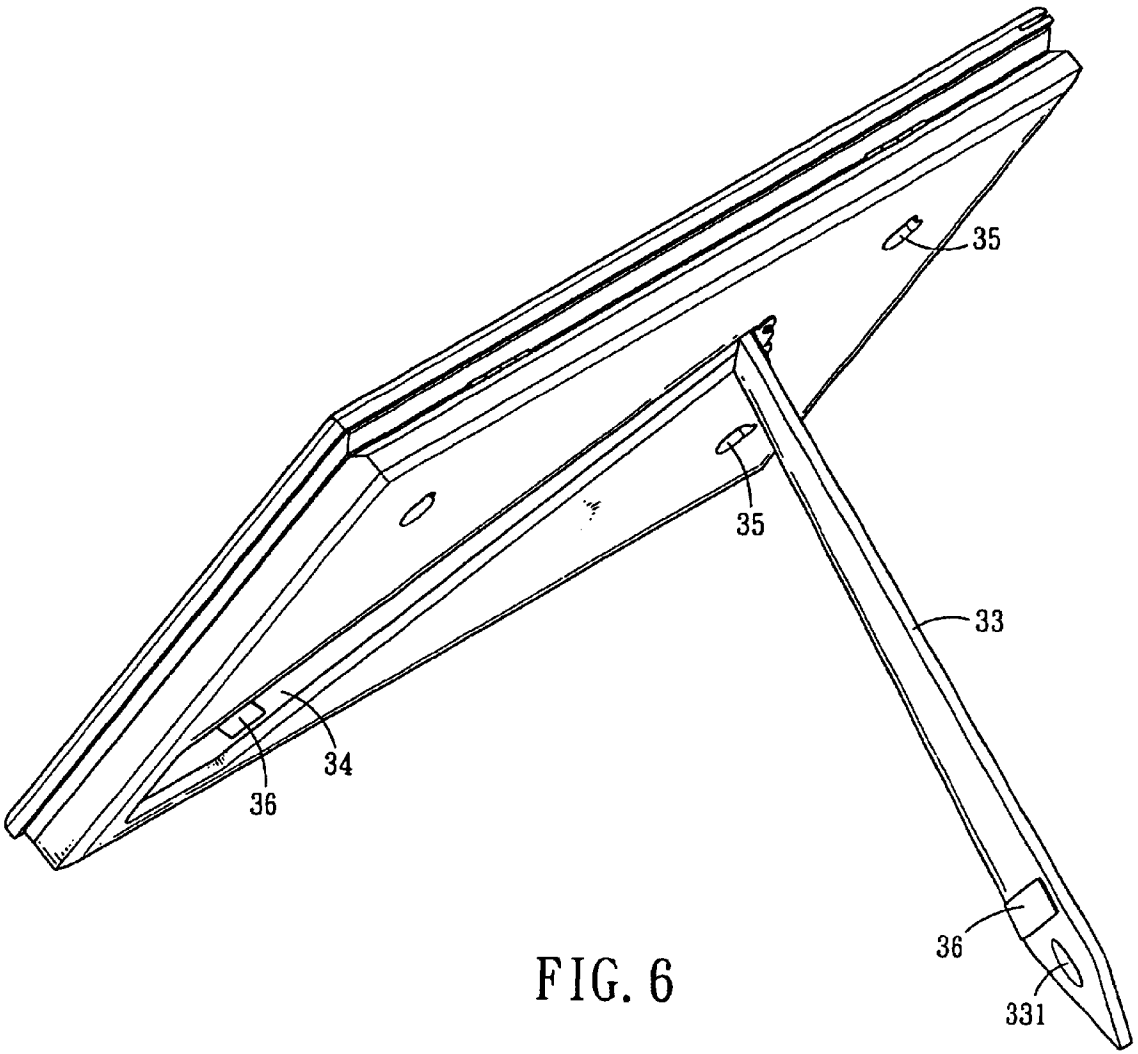
FIG. 6 is a back view of the photo-frame album in accordance with the present invention.

Referring to FIGS. 3, 4 and 6, wherein the lower divider 3 includes a thick board 31 and a thin board 32. On the thin board 32 are defined four stop pieces 321 and further formed plural slits 322. On the outer surface of the thick board 31 are provided a support stand 33, a receiving groove 34 and plural locating holes 35. The support stand 33 is provided with a magnetic piece 36 and at the corresponding position in the receiving groove 34 is defined another magnetic piece 36. A finger hole 331 is formed in the support stand 33, and the lower divider 3 is firmly engaged in the notch 22 of the lower frame 2.

Referring to FIGS. 2 and 4, the upper frame 4 is composed of a plurality of rims 41, the cross section of the upper frame 4 has a first stop face 42 and a second stop face 43. On the rims 41 of the upper frame 4 is provided a plurality of magnetic pieces 44 and a backing surface 45 (as shown in FIG. 5). The magnetic pieces 44 correspond to the magnetic pieces 23 on the lower frame 2. The upper frame 4 is connected with the lower fame 2 through a plurality of hinges 46 and a space is defined between the upper and the lower frames 2,4.

The upper divider 5 includes a thick board 51 and a thin board 52. The thin board 52 is provided with four stop pieces 521 and a plurality of slits 522. The upper divider 5 is fixed to the rims 41 of the upper frame 4 and forms an angle with respect to the second stop face 43, between the upper divider 5 and the first stop face 42 of the upper frame 4 a space 53 is defined.

Figure 7:
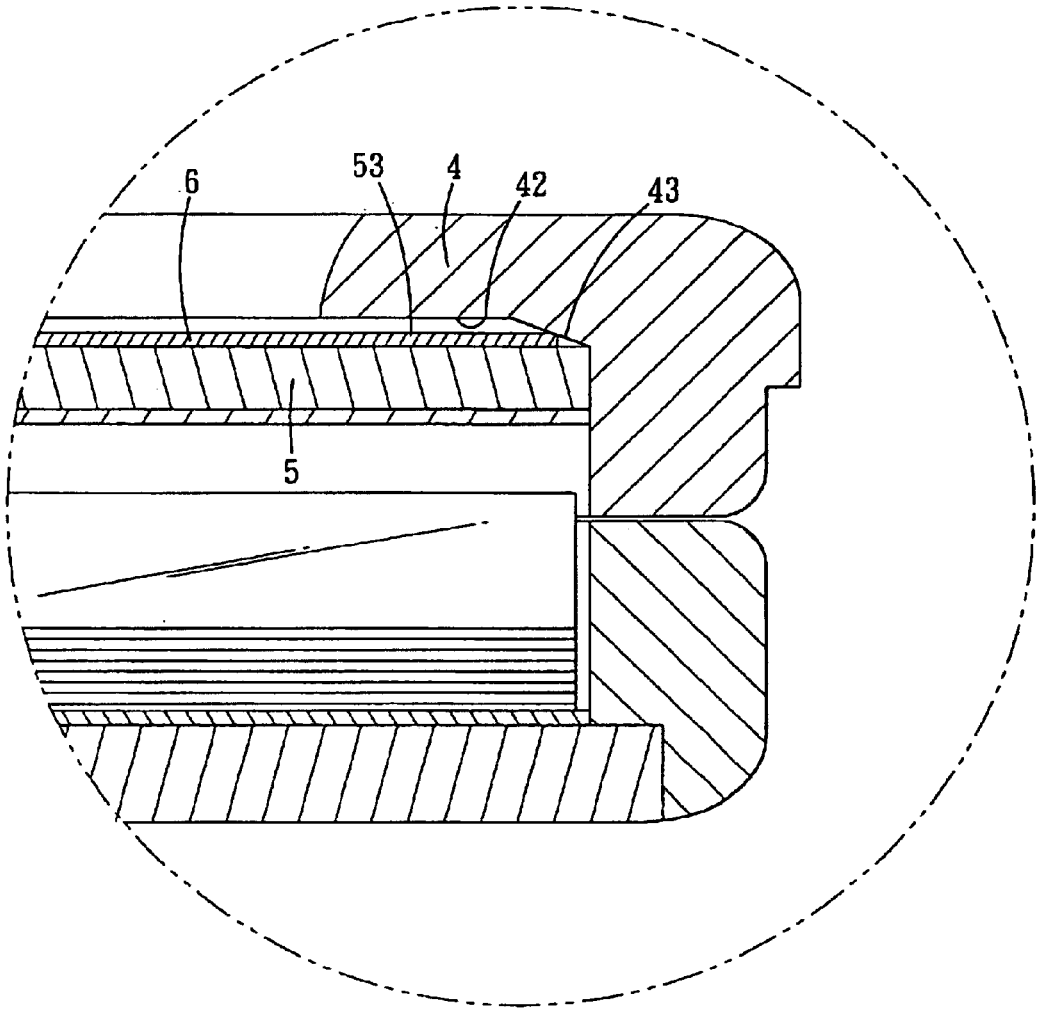
FIG. 7 is another partial amplified view of the photo-frame album in accordance with the present invention.

The photo-frame album in accordance with the present invention has the advantages as follows:

First, with reference to FIG. 7, the upper frame 4 has a upper divider 5 that forms an angle with respect to the second stop face 43, and the space 53 is formed between the upper divider 5 and the first stop face 42 of the upper frame 4, in this case, a large photo 6 can be firmly stored in the space between the upper frame 4 and the upper divider 5.

Second, as shown in FIG. 2, the rims 21, 41 of the upper frame 4 and the lower frame 2 are all provided with magnetic pieces 23, 24. The magnetic pieces 23,24 can be repeatedly used and will not be damaged after a long period of use, and thus the service life of the photo album of the present invention is prolonged.

Figure 8:
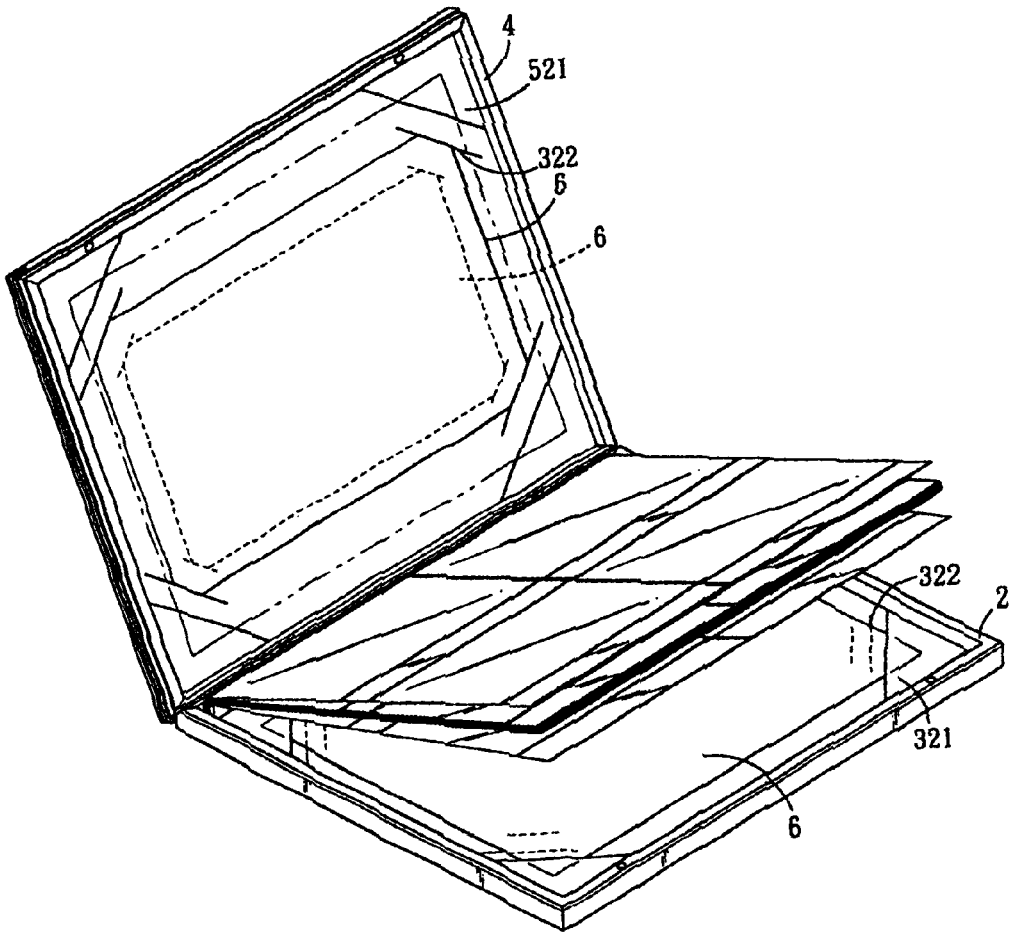
FIG. 8 is another perspective view of the photo-frame album in accordance with the present invention wherein the photo album is opened.

Third, as shown in FIG. 8, on the inner sides of the upper and the lower dividers 5, 3 of the upper and the lower frames 4, 2 are respectively provided a plurality of stop pieces 521, 321 and slits 522, 322. The respective stop pieces 521, 321 and the slits 522, 322 form three different sized spaces, and thus the upper and the lower dividers 5, 3 can hold different sized photos 6.

Fourth, as shown in FIGS. 5 and 8, in which, on the rims 41, 21 of the upper and the lower frame 4, 2 are respectively formed opposite backing surfaces 45, 25. When the upper frame 4 is lifted from the lower frame 2, the backing surfaces 45, 25 can enable the upper frame 4 to stand on the lower frame 2, such that the photo 6 on the upper divider is shown.

Fifth, as shown in FIG. 6, on the support stand 33 and at the corresponding position on the receiving groove 34 are provided the magnetic pieces 44 which enable the support stand 33 to be raised up and down repeatedly. Furthermore, the support stand 33 can be raised by a finger inserting through the finger hole 331.

Figure 9:
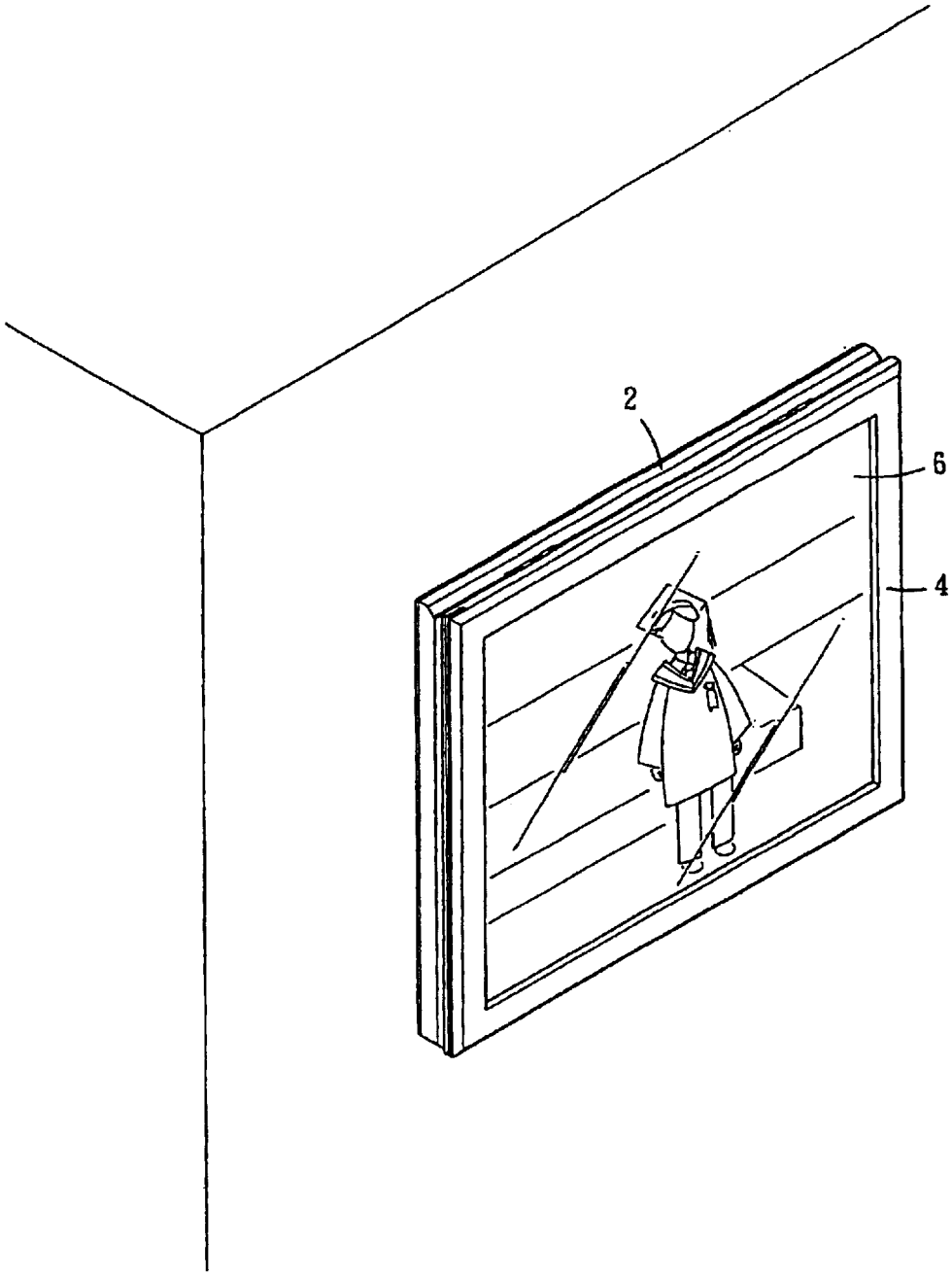
FIG. 9 is an illustrative view of showing the photo-frame album of the present invention being hanged on a wall.

Sixth, with reference to FIGS. 6 and 9, since the lower divider 3 of the lower frame 2 is provided with the support stand 33 and formed with the locating holes 35, the photo album of the present invention can be wall mounted or can stand on table.

While we have shown and described various embodiments in accordance with the present invention, it should be clear to those skilled in the art that further embodiments may be made without departing from the scope of the present invention.

What is claimed is:

1. A photo-frame album including:

a lower frame provided with a notch, a plurality of magnetic pieces, a plurality of loose-bags and a backing surface;

a lower divider comprising a thick board and a thin board, the thin board provided with plural stop pieces and formed with a plurality of slits; on an outer surface of the thick board is provided a support stand and a receiving groove, wherein the support stand is provided with plural magnetic pieces and the receiving groove is also provided with plural magnetic pieces in response to the magnetic pieces on the support stand, the support stand is formed with a finger hole, the lower divider is firmly engaged in the notch of the lower frame;

an upper frame, whose cross section comprises a first stop face and a second stop face, the upper frame is provided with a plurality of magnetic pieces and a backing surface, the magnetic pieces correspond to the magnetic pieces on the lower frame, the backing surface of the upper frame corresponds to that of the lower frame, the upper frame is connected with the lower fame through hinges, and a space is defined between the upper frame and the lower frame;

an upper divider comprising a thick board and a thin board, the thin board is provided with plural stop pieces and plural slits, the upper divider is fixed to the upper frame and forms an angle with respect to the second stop face, another space is formed between the upper divider and the first stop face of the upper frame.

2. The photo-frame album as claimed in claim 1, wherein the size of the loose-bags is 4×6 inches (L×W).

3. The photo-frame album as claimed in claim 1, wherein the size of the loose-bags is 6×8 inches (L×W).

4. The photo-frame album as claimed in claim 1, wherein the size of the loose-bags is 10×12 inches (L×W).

5. The photo-frame album as claimed in claim 1, wherein the thin board of the upper frame and the lower frame are, respectively, provided with four stop pieces.

6. The photo-frame album as claimed in claim 1, wherein a plurality of locating holes are formed on an outer side of the thick board of the upper frame and the lower frame.

* * * * *